US009984837B2

(12) United States Patent
Ockert et al.

(10) Patent No.: US 9,984,837 B2
(45) Date of Patent: May 29, 2018

(54) MULTI CONFIGURABLE ALARM STATION INCORPORATING A PUSH BUTTON ASSEMBLY AND ASSEMBLY KIT THEREFOR

(71) Applicant: Safety Technology International, Inc., Waterford, MI (US)

(72) Inventors: John Ockert, Davison, MI (US); Brian Hodges, White Lake, MI (US)

(73) Assignee: Safety Technology International, Inc., Waterford, MI (US)

( * ) Notice: Subject to any disclaimer, the term of this patent is extended or adjusted under 35 U.S.C. 154(b) by 138 days.

(21) Appl. No.: 15/222,675

(22) Filed: Jul. 28, 2016

(65) Prior Publication Data

US 2018/0033572 A1 Feb. 1, 2018

(51) Int. Cl.

| | |
|---|---|
| ***H01H 13/14*** | (2006.01) |
| ***G08B 25/12*** | (2006.01) |
| ***H01H 13/04*** | (2006.01) |

(52) U.S. Cl.

CPC ..... *H01H 13/14* (2013.01); *G08B 25/12* (2013.01); *H01H 13/04* (2013.01); *H01H 2219/037* (2013.01); *H01H 2235/01* (2013.01)

(58) Field of Classification Search

CPC .. H01H 13/14; H01H 13/04; H01H 2219/037; H01H 2235/01; G08B 25/12

USPC ..... 200/310, 341, 527, 293

See application file for complete search history.

(56) References Cited

U.S. PATENT DOCUMENTS

| | | | | |
|---|---|---|---|---|
| 3,863,043 | A * | 1/1975 | Boyd | H01H 71/46 200/310 |
| 4,267,549 | A | 5/1981 | Taylor | |
| 5,424,516 | A * | 6/1995 | Emmons | H01H 3/125 200/341 |
| 5,920,050 | A * | 7/1999 | Tolman | H01H 9/18 200/302.2 |
| 5,955,939 | A | 9/1999 | Taylor | |
| 6,902,287 | B2 | 6/2005 | Taylor | |
| 8,921,724 | B2 * | 12/2014 | Young | H01H 13/60 200/345 |
| 2007/0062787 | A1 | 3/2007 | Miura et al. | |

(Continued)

FOREIGN PATENT DOCUMENTS

| | | |
|---|---|---|
| CN | 200990297 Y | 12/2007 |
| JP | 02-024435 | 2/1990 |

(Continued)

*Primary Examiner* — Edwin A. Leon

(74) *Attorney, Agent, or Firm* — Dinsmore & Shohl LLP

(57) ABSTRACT

A kit incorporating a multi-configurable push-button subassembly for installing an emergency stop/deactivate alarm station which can be configured to operate in any of a momentary (depress and immediate reverse bias return) resetting of a previously inwardly depressed push-button, a latching turn-to-reset for the push button, or a latching key-to-reset for (outwardly) resetting the push button following initial depressing of the same in response to a determined alarm condition. The push button subassembly is integrated into an overall alarm station assembly including a gang box body and attachable backing plate, within which existing switch and wiring components are integrated. A cover attaches over the assembly and both exposes and shields the push button from inadvertent depressed triggering in particular from a side location.

20 Claims, 14 Drawing Sheets

(56) References Cited

U.S. PATENT DOCUMENTS

| | | | |
|---|---|---|---|
| 2010/0243418 | A1 | 9/2010 | Machida et al. |
| 2011/0179838 | A1 | 7/2011 | David |
| 2014/0008198 | A1 | 1/2014 | Huang |

FOREIGN PATENT DOCUMENTS

| | | | |
|---|---|---|---|
| JP | 2007207600 | A | 8/2007 |
| JP | 2010033797 | A | 2/2010 |
| JP | 5009872 | B2 | 8/2012 |
| KR | 101680372 | B1 | 11/2016 |

* cited by examiner

MULTI CONFIGURABLE ALARM STATION INCORPORATING A PUSH BUTTON ASSEMBLY AND ASSEMBLY KIT THEREFOR

FIELD OF THE INVENTION

The present invention relates generally to an alarm station incorporating an emergency push stop/deactivate button. More specifically, the present invention discloses a multi-configurable kit for installing an emergency stop/deactivate alarm station which can include any of momentary (depress and immediate reverse bias return), a latching turn-to-reset ring, or a latching key-to-reset for (outwardly) resetting the push button following initial depressing of the same in response to a determined alarm condition.

BACKGROUND OF THE INVENTION

Emergency stop assemblies, such as incorporating a push button, are known in the prior art. In a first example, this can include a push button switch for an emergency stop such as is disclosed in JP 2007/207600 which teaches an operational part and a switch part, with the operation part locked in a plunged state when pressingly operated. Upon being twisted, the operation part is unlocked and restored to the wait position.

CN 2009/90297 includes a resetting starting device and manual fire alarm button using the device. In an alarm state, and operating panel is depressed with a bottom horizontal portion moving into contact with a switch. A resetting tool is inserts through a hole for resetting the panel to the original (pre-depressed) position.

JP 2010/033797 teaches a push-button switch for an emergency stop preventing immediate restoration action and which includes a push rod for opening and closing a switch and which is axially connected to the push button for free movement. A driving spring is provided for biasing the push rod in the axial direction. A lock mechanism includes a first securing means for securing the push rod in a standby position and, with a second securing means for securing the push rod in an inwardly displaced condition in conjunction with depressing of the push button. A separate restoration/reset provides for returning the push rod to the standby position in conjunction with restoration/resetting of the push button.

Other references of note include the alarm station protector, U.S. Pat. No. 5,955,939, the pull station protector, U.S. Pat. No. 4,267,549 and the environmentally controlled appliance enclosure, U.S. Pat. No. 6,902,287, all to Taylor.

SUMMARY OF THE INVENTION

The present invention a kit for installing an emergency stop/deactivate alarm station. The kit includes a multi-configurable push-button subassembly in which an arrangement of interchangeable components, including a wedge block, reset ring and stop pin are reconfigured in different variants in order to establish any of a momentary depress and reverse bias reset return, a latching turn-to-reset, or a latching key-to-reset for (outwardly) resetting the push button following initial depressing of the same in response to a determined alarm condition. The selected configuration of push button subassembly is integrated into an overall alarm station assembly including a gang box body and attachable backing plate, within which existing switch and wiring components are integrated. A cover attaches over the assembly and both exposes and shields the push button from inadvertent depressed triggering (in particular from a side location). Customizable labeling and identification (including color coded backing surfaces) can be provided for tailoring the alarm station assembly to a particular application.

BRIEF DESCRIPTION OF THE DRAWINGS

Reference will now be had to the attached drawings, when read in combination with the following detailed description, wherein like reference numerals refer to like parts throughout the several views, and in which.

DETAILED DESCRIPTION OF THE PREFERRED EMBODIMENTS

With reference to the following illustrations, the present invention discloses a multi-configurable kit for installing an emergency stop/deactivate alarm station for any of a number of commercial or industrial applications. Such alarm conditions can, without limitation, relate to any of electrical environments, hydraulic/pneumatic pressure situations (such as loss of fluid pressure in a critical operation, a fire or other emergency occurrence), or other monitoring environments in which a timely alarm and concurrent tripping or deactivation of the associated process is desired.

As will be further described, the kit can be configured in a number of different variants to best complement the operating environment within which it is installed. This includes issuing any form of audio, visual and electronic alarm warning, along with a variety of different configuration options for providing any of momentary resetting (depress and immediate reverse bias return) or a delayed resetting. The delayed resetting options can include either of a latching turn-to-reset of an associated rotatable reset ring, or a latching key-to-reset using a separate insertable key for (outwardly) resetting an associated push button following initial depressing of the same, and in response to the determined alarm condition.

Figure 1:
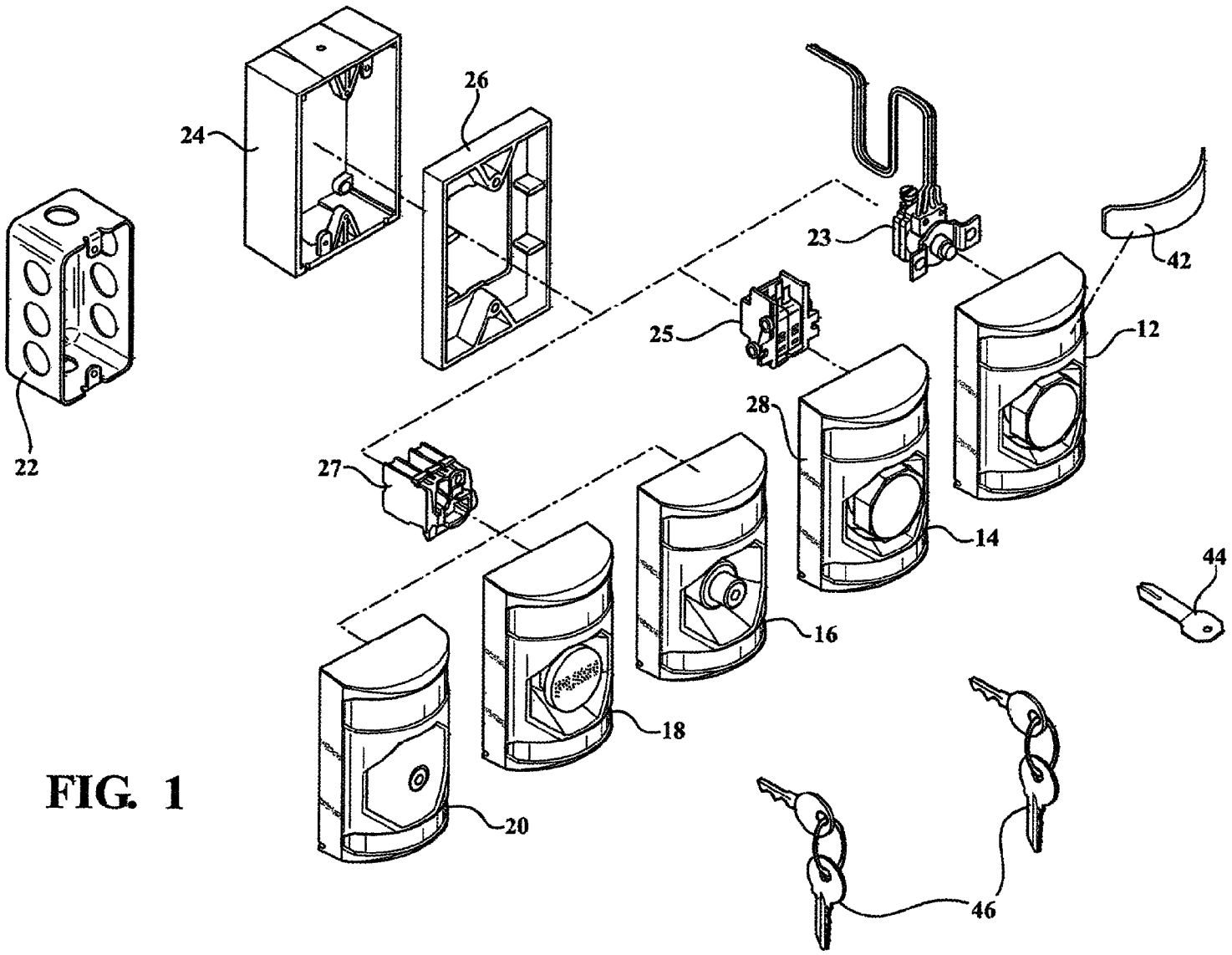
FIG. 1 is an exploded kit view of the present invention and which illustrates a variety of different variants which can be utilized with either of a single gang box or color back box, a spacer or back plate, and an attachable protector cover.

Referring initially to FIG. 1, an exploded view is generally depicted at 10, of one variant of the present invention and which illustrates a variety of different variant subassemblies, see at 12, 14, 16, 18 and 20, and as will be described in further detail. As will be further described, the push button subassemblies are alternatively utilized with a common single gang box 22.

Alternatively, a color back box 24 and be provided in combination with an inter-posed color STI spacer component 26, the spacer adding depth to the associated box for facilitating switch clearance in combination with application to the various push button, key to reset and turn to reset variants. The spacer 26 is also understood to provide all of the functionality of a backing plate which is interposed between the single gang box 22 or colored back box 24.

As further depicted, various switch constructions which can be utilized with the alarm station subassemblies include each of a pneumatic adjustable timer button 23 (associated with pneumatic adjustable timer subassembly 12), a lower profile contact switch 25 (associated with a combination key to reset, momentary and turn to reset alarm station subassembly 14), a standard depth contact switch 27 (associated with each of key to activate subassembly 16, combination push to activate/turn to reset sub-variant and momentary push sub-variant 18, and push to activate and key to reset subassembly 20).

The backing plate or spacer 26, in combination with either of a fixed or pivotally attachable pull station protector cover, such as shown 28 in relation to selected combination subassembly 14, can include a clear or substantially translucent/transparent three dimensional shaped plastic housing which can be either fixed or pivotally secured to the spacer 26 in order to overlay and surround the push button subassembly. Without limitation, the various options for the push button and reset subassemblies as shown can include, in any combination, any of a pneumatic/adjustable timer illuminated button, a standard illuminated button, a multi-configurable key-to-reset, momentary, turn-to-reset illuminated button, a key-to-activate, push-to-activate and turn-to-reset/momentary and, finally, push to activate/key to reset.

For purpose of the present disclosure, the selected pushbutton and reset subassemblies 12, 16, 18 and 20 combine one or more of the individual configurations or variants which can be integrated into the overall kit, with the pushbutton subassembly 14 providing the multi-variant reconfiguration to any of momentary, key-to-reset and turn-to-rest variants. Indicia applications to the cover portion of the given subassembly can also include direct print with ultra-violet (UV) curable ink, such as which can be integrated into a customized mold during formation of the body, cover, backing plate, etc.). While any colorization scheme is envisioned with the present invention, it is also generally understood that the color red is typically most well known in relation to an emergency stop push button.

Figure 1A:
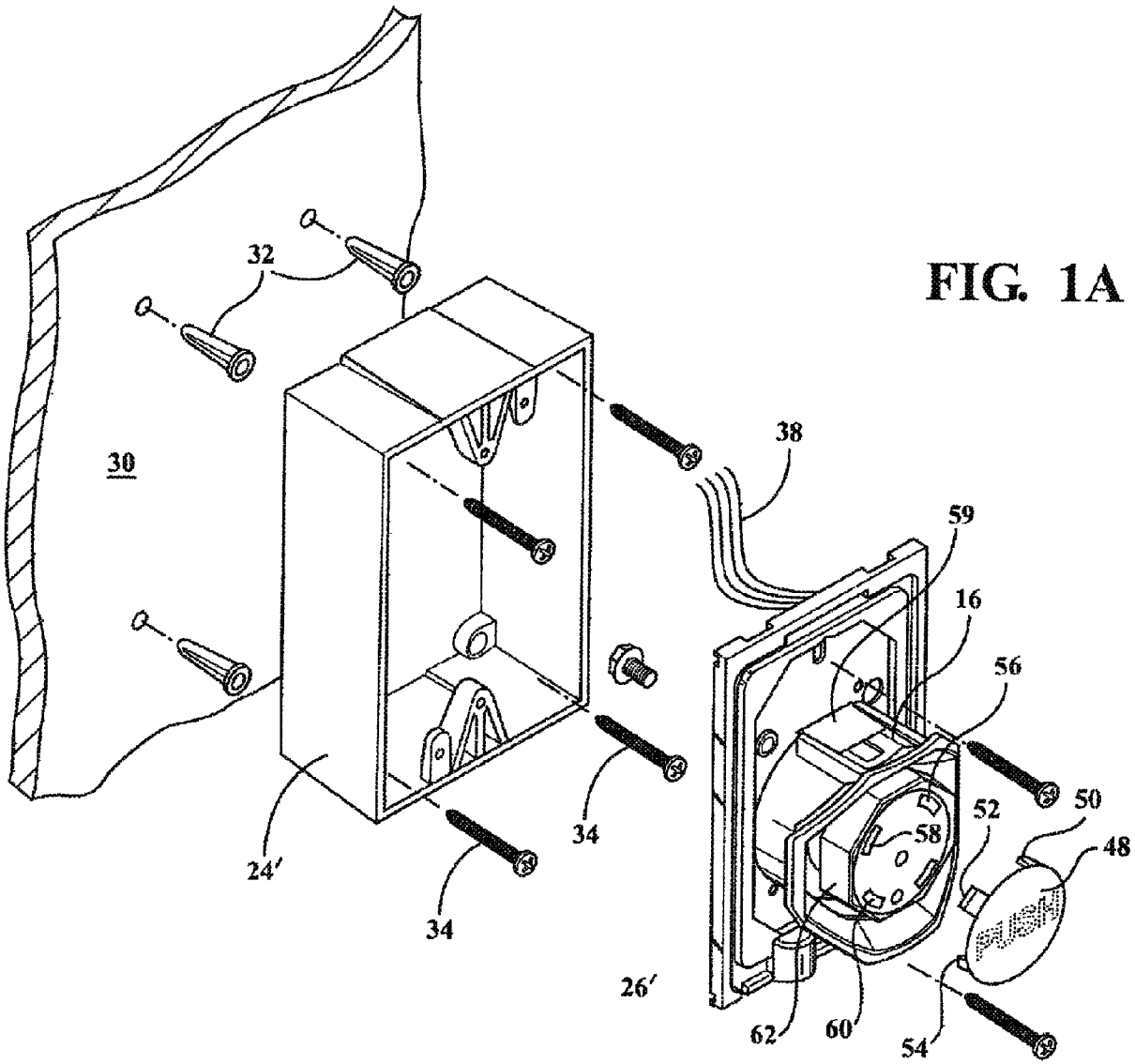
FIG. 1A is a further exploded installation view depicting the back plate and selected multi-configurable push button subassembly mounted to a variation of a gang box.

The gang box 24 (see also variant 24' as shown in FIG. 1A) can include any known construction and which is mounted to a wall surfaces (further at 30) via wall anchors 32 or the like which receive mounting screws 34 configured to secure through mounting surfaces defined in the gang box 24. As further shown in the cutaway views of FIGS. 9-10, additional features such as a switch box 36 are integrated into the gang box 24 underneath the mounted back plate 26 and which is communicated by wiring (see at 38 in FIG. 1A) extending from the rear side of the back plate, such engaging the inner side of the pushbutton subassembly (e.g. at 16) through a central mounting aperture (see inner perimeter defined rim surface 40 in FIG. 1A) defined in the back plate 26.

Other features associated with the exploded view of FIG. 1 include a customized label 42 which can be attached to the exterior of any selected subassembly cover (see again at 12) and which can exhibit any suitable text appropriate to the function of the alarm station, non-limiting examples of which can include such as "FUEL PUMP SHUT-DOWN", "EMERGENCY", "EXIT", etc., and which can further correspond with selected colors (e.g., red, blue, yellow, white, green) of the housing and, optionally, the pushbutton. As further shown, selected multi-configurable push button subassembly 14 may further include a uniquely shaped key 44 (this shown in further detail in FIG. 6), with other conventional keys 46 associated with either of the key-to-activate 16 or key to reset 20 subassemblies. Other features, such as LED illuminating of the button is provided for and will be subsequently described in additional detail.

As again referenced in FIG. 1A, selected multi-configurable push button subassembly 16 is shown mounted to the variation of a gang box. A snap on cap 48 is depicted, such as which can exhibit appropriate script (e.g. "PUSH"). Tabs 50, 52, 54, et seq. of the cap 48 are aligned with and engaged to mating and aligning slots 56, 58, 60, et seq., configured upon a mounting surface of a button portion 62 the push-button subassembly 16. Also shown at 59 is an LED board which can be secured to a face of the backing 26' at a location about the push button housing and which, as will be further described, provides options for multi-colored illumination of the shroud space surrounding the housing.

Figure 2:
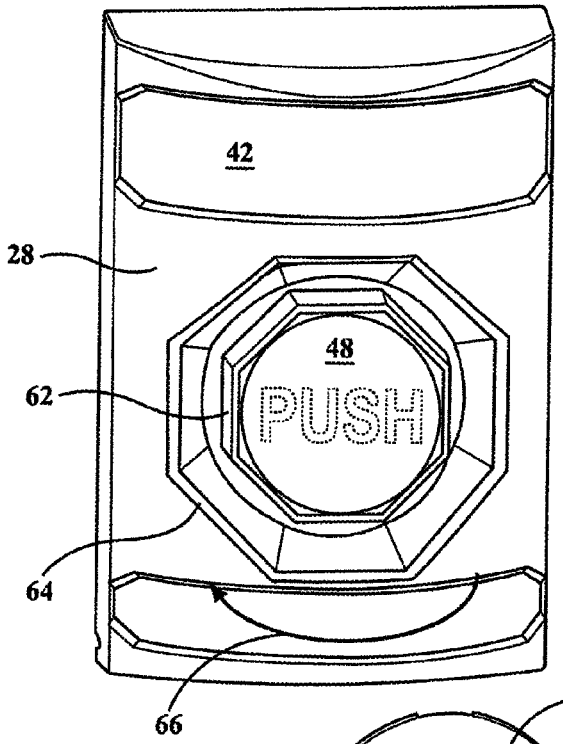
FIG. 2 is a front assembled view of a selected variant of the multi-configurable kit including a rotate to reset ring.

Beginning with FIG. 2, a description will now be had of the multi-configurations of the selected push-button subassembly 16 which accomplish the different momentary, turn to reset and key to reset variants. With reference to FIG. 2, a front assembled view is shown of a selected variant of the multi-configurable push button forming a portion of the alarm kit.

As shown, a recess configuration defined within the front of the push-button subassembly is further exhibited by a recess angled surfaces, these collectively defining a recess shroud as shown at 64, which seat the push button portion 62 from the outside surface of the cover 28 and thereby prevents inadvertent depression thereof (such as from a side location) resulting from brushing against the cover. As further referenced at 66, the push button portion 62 can be rotatable (via a rotating reset ring) as described in FIG. 3 et seq., in order to reset (outwardly return) the push button 62 once the same has been depressed.

Figure 3:
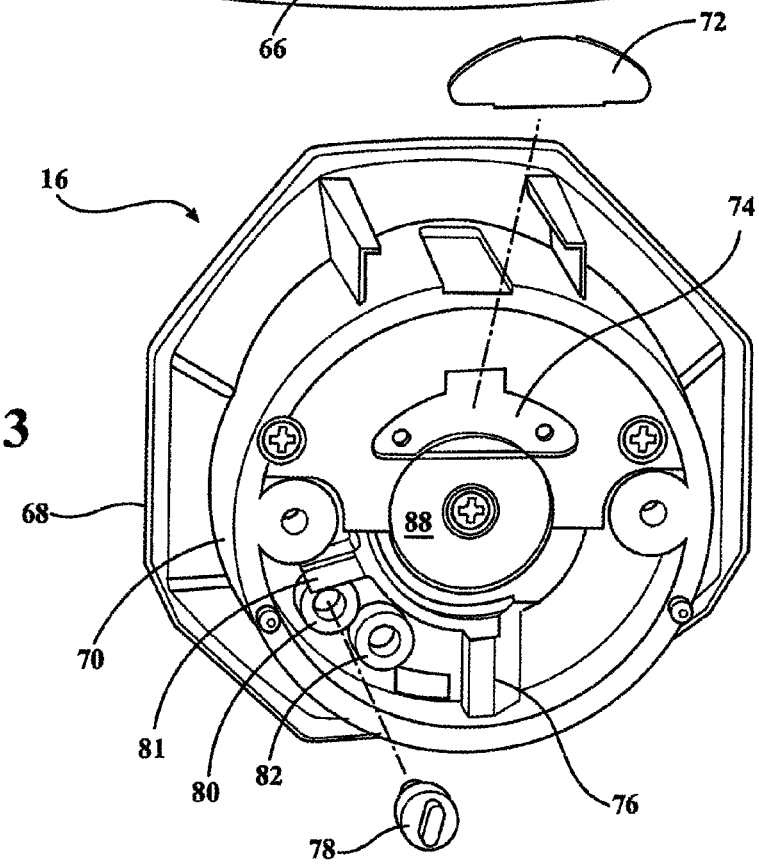
FIG. 3 is a rotated and rear perspective of the multi-configurable subassembly of FIG. 2 and illustrating a removable wedge block in combination with a position engageable stop pin for defining a range of rotating motion of the reset ring for effectuating pop-out resetting of the centrally located push button.

Referring to FIG. 3, a rotated and rear perspective is shown of the body 16 defining the multi-configurable subassembly of FIG. 2. Features such as an outer polygonal defined perimeter fringe 68 are shown for receiving the push button 62, as is an inner and depth extending cylindrical body 70 for containing the various reconfigurable subcomponents of the assembly and including such as pin connectors, switches and/or contacts for engaging the wire harness 38 of FIG. 1A in contact with the components in the gang box 24.

A removable wedge block 72 is illustrated and which can be snap-engaged or otherwise affixed to a recess 74 defined in a rear end face of the body 70. A rotatable resent ring is further depicted at 76 and which can be displaced, such as up to a ¼ turn, based on the positioning of a stop pin 78 within a selected receiving location 80 or 82 associated with the back end face of the body 70.

Figure 14:
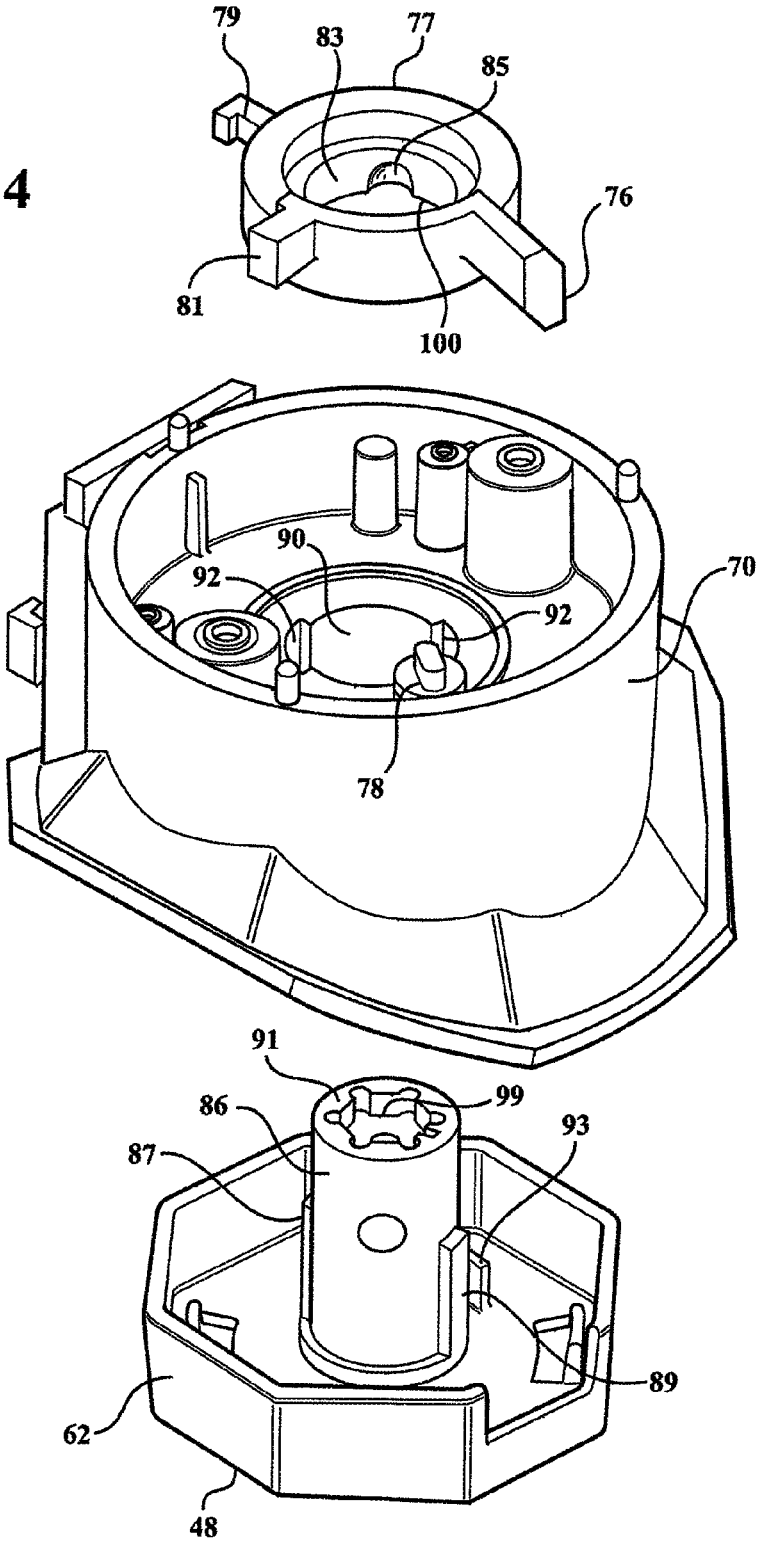
FIG. 14 is an exploded view of the push button housing, push button with elongated actuator stem configured with outer axial embossments and reset ring.

With reference to the exploded view of FIG. 14, the portion of the reset ring referenced in the other various assembly views is the cam edged tab 76, which can be actuated in the key-to-reset variant in order to outwardly displace the push button assembly to the pre-actuated position. As further shown in FIG. 14, the reset ring includes a main annular body 77 from which a pair of other outwardly radially extending stop tabs 79 and 81 are configured. The main annular body 77 of the reset ring further exhibits an inner profile exhibiting inner surface communicating recesses 85, these cooperating with the exterior configuration of the push button stem as described below and in order to provide for outward resetting of the push button following the initial inward depressing/triggering step.

In the configuration again depicted in FIG. 3, the wedge block 72 is removed and the stop pin 78 is removed from the lower receiving location 80 in order to permit the resent ring 76 to rotate in the clockwise direction 66 depicted in FIG. 2, following which the stop pin is reattached to the upper location 82, hereby holding the ring 76 in place in the rotated position.

In the variant of FIGS. 2-3, the reset ring 77 is reconfigured for effectuating pop-out resetting of the push button 62 upon rotating a selected rotation distance (typically less than a turn) following a previous depression of the push button, such as again following the incidence of an alarm event. As will be described with reference to FIGS. 9A-11, a series of cutaway views provide additional detail in explanation of this functionality and in which a return coil spring 84 (see FIG. 10) is seated underneath the push button 62 and inner stem support 86.

As depicted in FIG. 14, the stem 86 further exhibits linear external embossments 87 and 89 which extend from a base inner surface adjoining the push button 48 to an extended location short of an end face 91 of the stem 86. Also depicted is a tab 93 associated with an underside of the push button inner face and which anchors a second outer end 95 of the coil spring 84, an opposite inner end 97 of the main coil spring shown in the FIG. 11 cutaway which anchors to a location of the housing for biasing the push button 62 in a counter-direction to the rotate to reset direction depicted in FIG. 10B.

An enlarged inner collar (also termed an actuator base) 88 is illustrated in each of FIGS. 9A-11, and is associated with the stem support 86 (such being affixed over the recess profile shown at 99 in the stem 86 depicted in FIG. 14). The collar 88 is displaced upon pressing in of the push button 48, such as is guided by inner channeled aperture 90 with winged guiding locations 92 which is also depicted in exploded perspective of FIG. 14 directed to the main push button housing. A reset return spring 94 (FIG. 9) is also depicted and which influences a (counter clockwise) biasing direction of the reset ring 77. A pair ball bearings 93 and 95 abut opposite ends of the spring 94 and seat with the recessed configurations 85 in the reset ring 77.

Yet additional features include an insulated bushing 96 (see FIG. 8) defined in the front face of the back plate 26. A light pipe and PCB assembly 98 (see FIG. 11) is configured upon a proximate front surface of the outer perimeter recess shroud 64 and, upon communicating to a local power source (not shown), operates in order to illuminate the button face 48 and surrounding perimeter portion 62 in low light conditions. To this end, an associated wiring chip associated with the light pipe and PCB assembly can include a plurality of wires, including a common to ground with further selected wires provided according to color (e.g. white, green, red, etc.), the connection of one of these resulting in a given color being visible through a transparent or translucent coating associated with the housing and so that it is visible around the perimeter of the push button and recessed pocket 64 (FIG. 2).

Returning again to the turn to reset variant of FIGS. 2-3, and upon pressing the button 48, the actuator base 88 of the inner stem 86 is caused to inwardly displace into the space normally blocked by the (removed) wedge plate 72. In this position, the stem 86 and associated collar are effectively shouldered or captured in the depressed condition by a projection 100 associated with the inner surface of the reset ring 74 (see again FIG. 14), and so that the actuator base 88 trips or depresses a beam 102 (FIG. 9B) for closing a switch with the switch box 36.

In order to reset the assembly to the original position, it is required that the actuator 88 be displaced outwardly and away from the contact beam 102. In either the rotate to reset or key to resent configurations, it is necessary that the rotational interface established between the inner surface profile of the reset ring 77 (see again at 100 with circumferentially spaced recess pockets 85 in FIG. 14 which again seat the ball bearings 93/95 at opposite supporting ends of the spring 94) and the exterior of the push button stem 86 (further with axial embossments 87/89) be rotationally aligned so that the recesses 86 and the embossments 87/89 permit the coil spring 84 to outwardly unseat the push button 48 to the original/pre-depressed condition, this further resulting from the spring 84 pushing against the inside mushroom portion of the button portion 62 and its cap 48, thereby "popping out" the button portion to its pre-depressed condition (thereby completing resetting of the sub-assembly).

Figure 4:
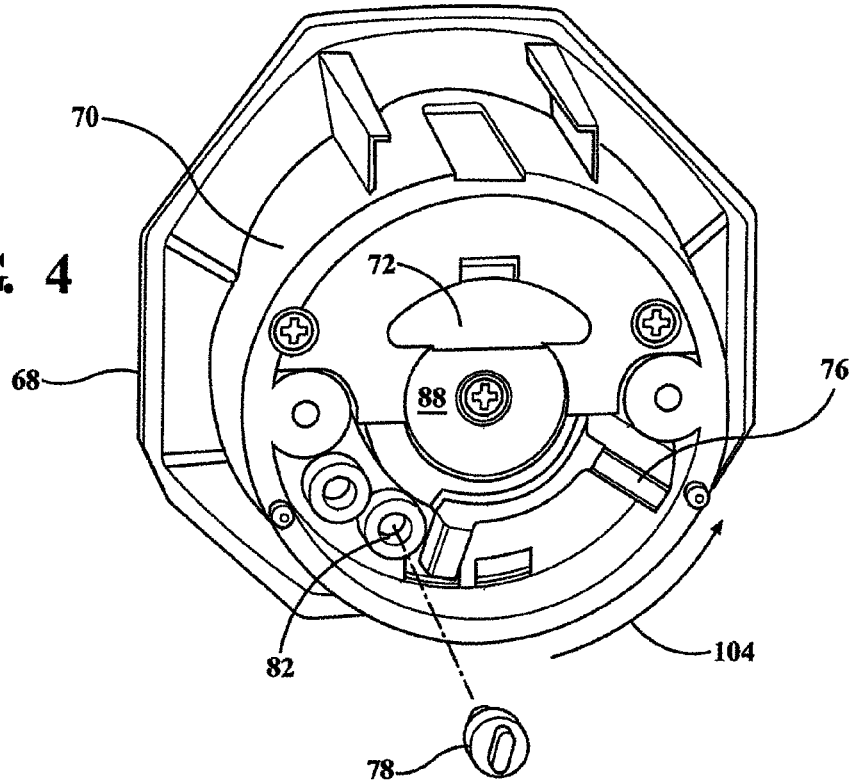
FIG. 4 is a view similar to FIG. 3 depicting the reinstalled wedge block and repositioned stop pin for reconfiguring the push button subassembly in a momentary (default) variant.

Referring back to FIG. 4, a view similar to FIG. 3 depicts the wedge block 72 reinstalled as shown, along with the reset ring 77 rotated in a counterclockwise direction (see arrow 104 in FIG. 10B) and the stop pin 78 repositioned in location 82 for reconfiguring the push button subassembly in a momentary (default) variant. In this configuration, the recessed inner perimeter location revealing the recesses 85 of the reset ring 77 is affixed opposing fashion relative to the embossed axial locations 87/89 of the displaceable stem 86, thereby allowing the reverse/outward bias of the main coil spring 84 to outwardly displace ("pop-out") the central push button mushroom portion 62.

Figure 5:
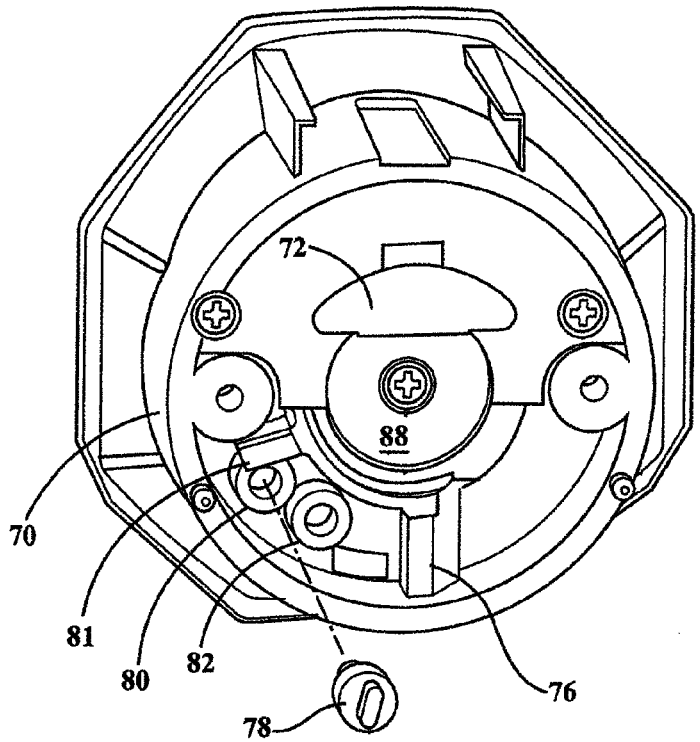
FIG. 5 is another view similar to FIG. 3 depicting the reinstalled wedge block and repositioned stop pin for reconfiguring the push button subassembly in a key to reset variant.

FIG. 5 is another view similar to FIG. 3, depicting the reinstalled wedge block 72 and repositioned stop pin 78 for reconfiguring the push button subassembly in a key to reset variant. In this variant, the stop pin 78 is removed from the lower receiving location 82. At this point, the reset ring 77 is rotated clockwise as illustrated at 66 in FIG. 2.

Figure 8:
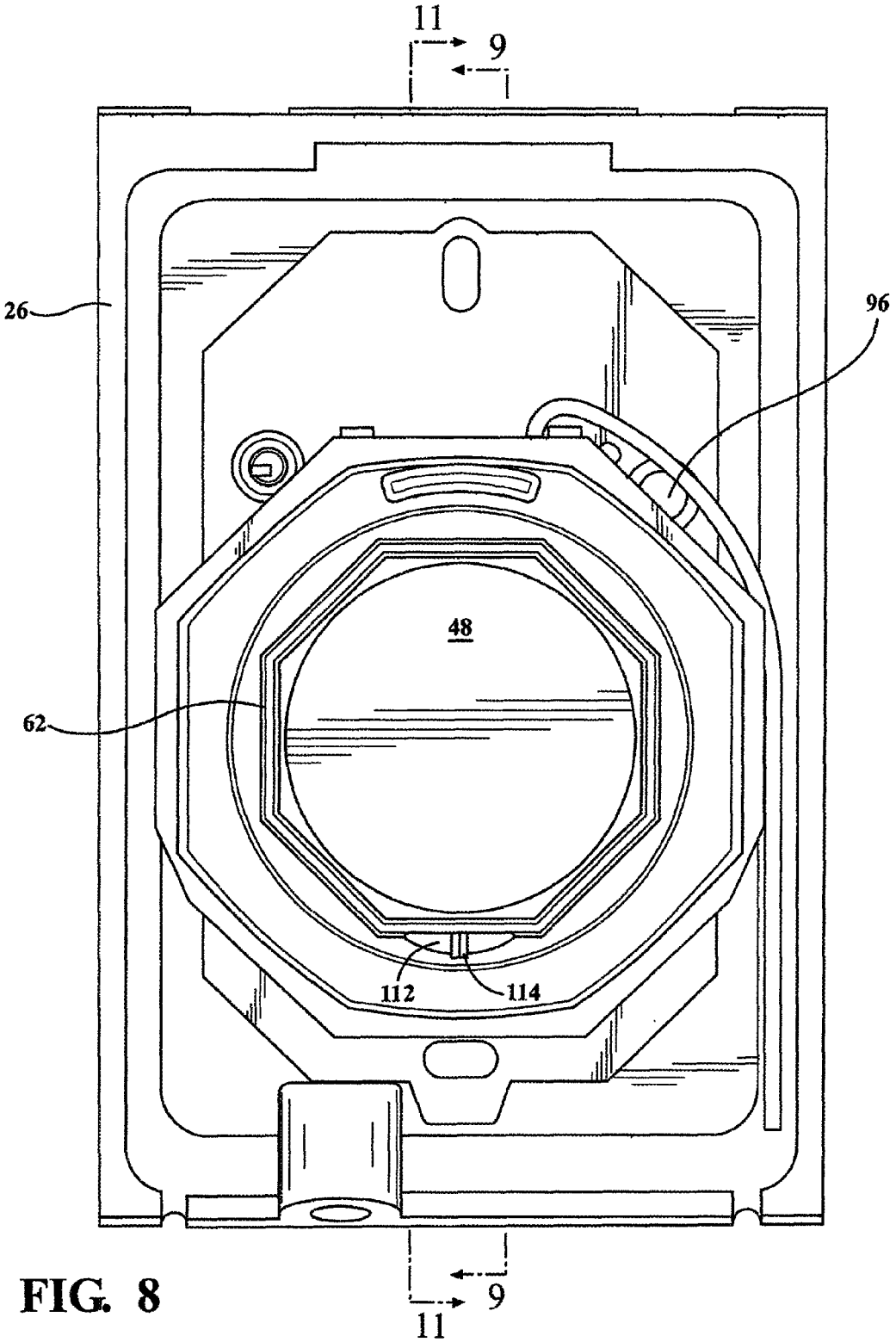
FIG. 8 is a front plan view of the push button assembly as generally depicted in FIGS. 1A and 2 and better illustrating the key to reset insertion slot.
Figure 9A:
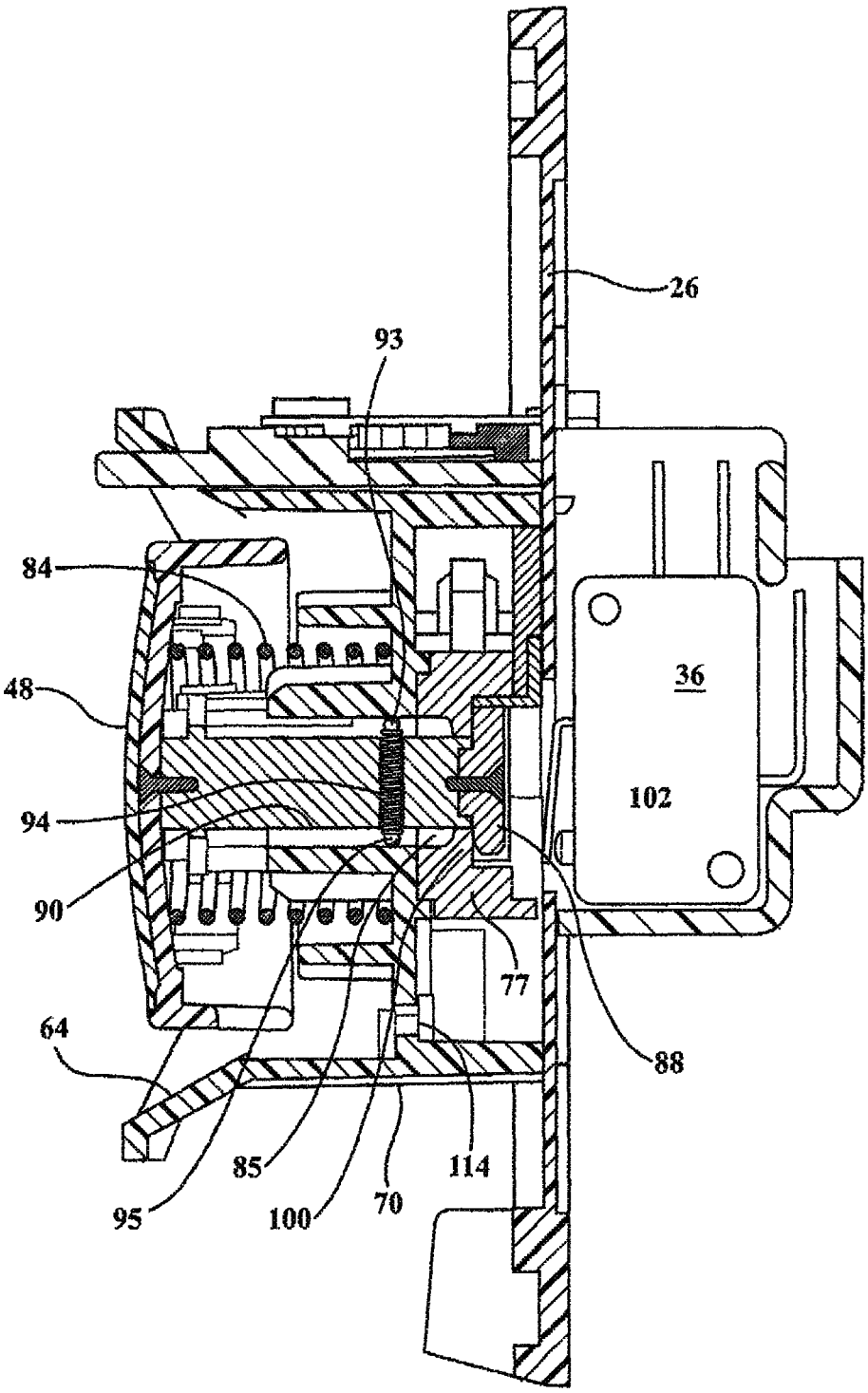
FIG. 9A is a sectional cutaway view taken along line 9-9 of FIG. 8 and depicting several features of the push button, actuator, reset ring, mounting plate and switch box associated with the present assembly in a first momentary in/out bush button configuration.
Figure 9B:
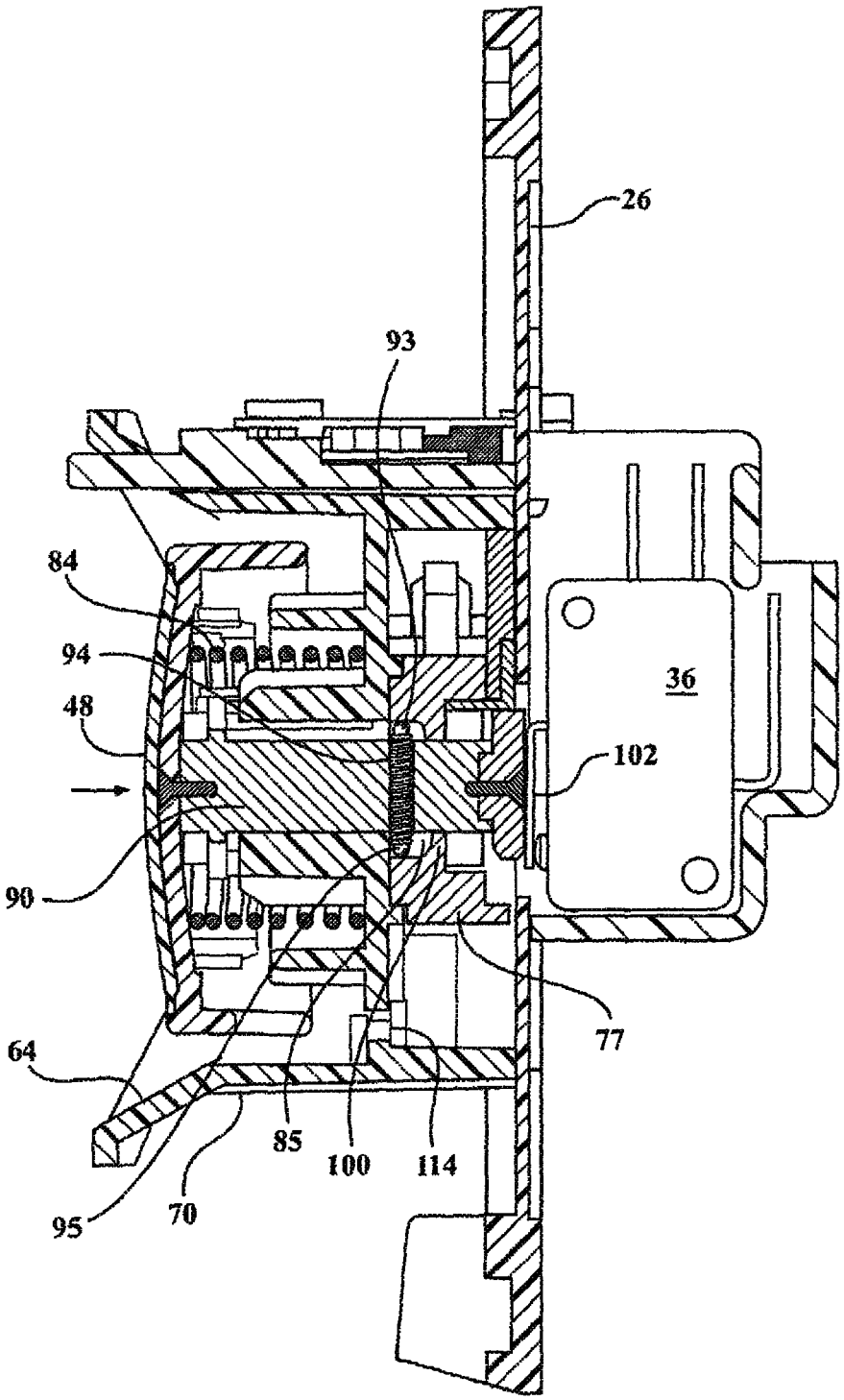
FIG. 9B is a succeeding illustration to FIG. 9A depicting the push button in an inwardly displaced position in which the actuator contacts the switch.
Figure 10A:
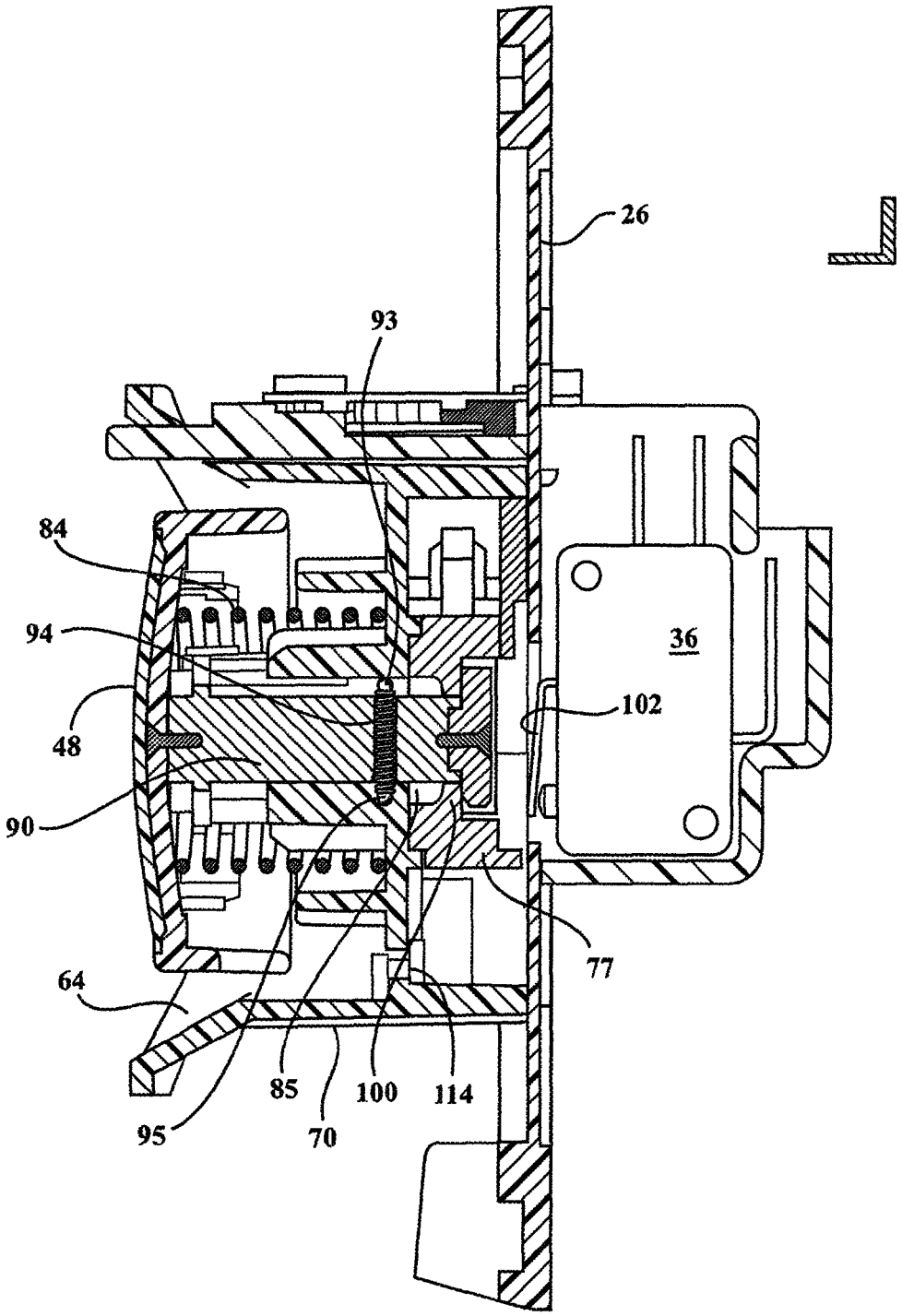
FIG. 10A is a sectional cutaway similar to FIG. 9A, and further showing the assembly reconfigured to a rotate to reset configuration.
Figure 10B:
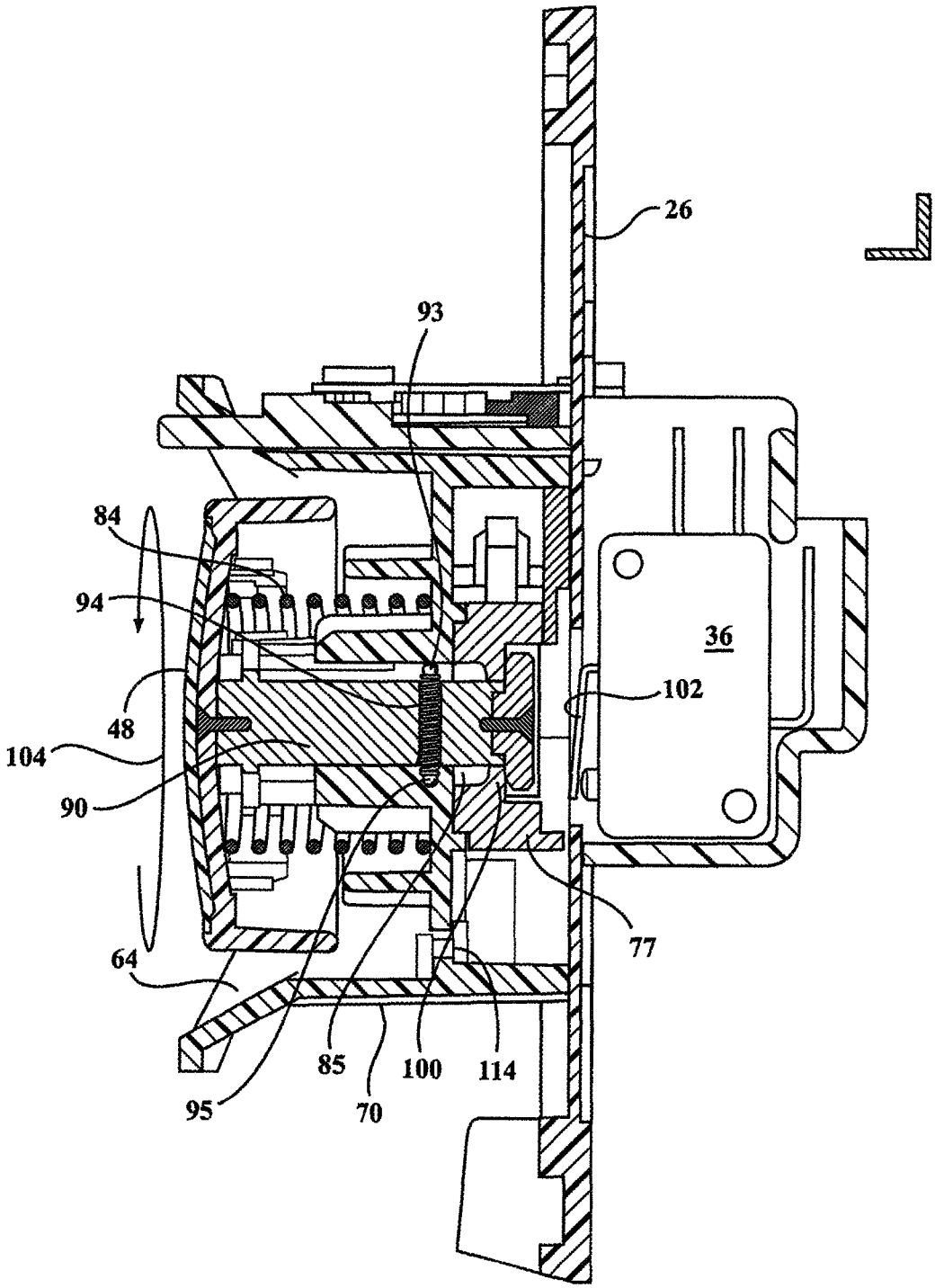
FIG. 10B is a succeeding illustration depicting the rotation of the push button in order to cause outward unseating of the stem and actuator from the reset ring, and upon alignment of recess notches configured in the central inner annular surface of the ring with axial embossments configured on the exterior of the push button stem.
Figure 11:
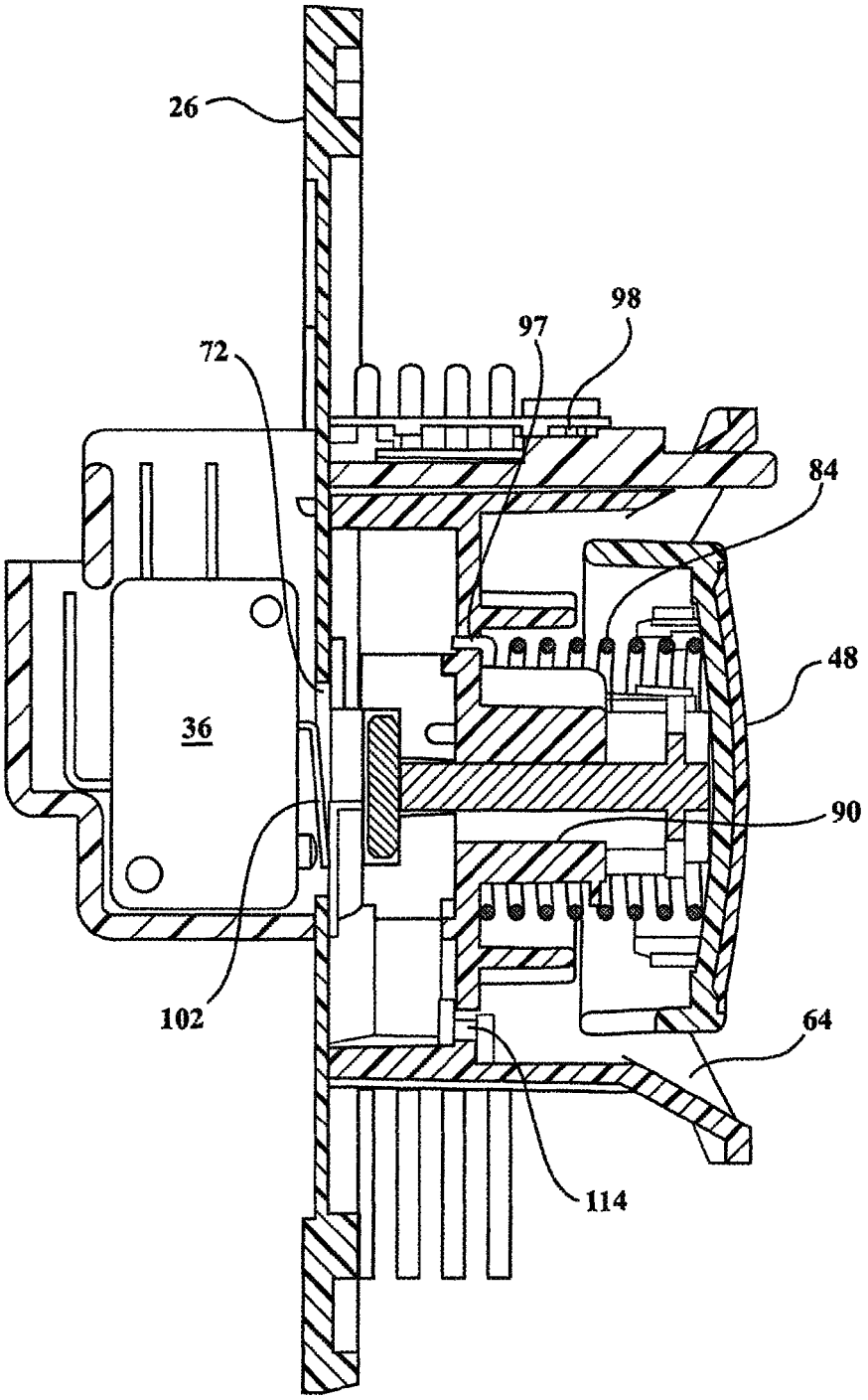
FIG. 11 is a further sectional cutaway taken along line 11-11 of FIG. 8 and showing a further aspect of the rotate to reset aspect of the present assembly including the manner in which the main supporting clock spring is anchored at opposite ends in a counter-biased fashion to the direction of the rotate to reset function of FIG. 10B.

Consistent with the above descriptions, FIG. 9A is a sectional cutaway view taken along line 9-9 of FIG. 8 and depicting several features of the push button, actuator, reset ring, mounting plate and switch box associated with the present assembly in a first momentary in/out bush button configuration, with FIG. 9B providing a succeeding illustration to FIG. 9A depicting the push button in an inwardly displaced position in which the actuator contacts the switch. Similarly, FIG. 10A is a sectional cutaway similar to FIG. 9A, and further showing the assembly reconfigured to a rotate to reset configuration with FIG. 10B providing a succeeding illustration depicting the rotation of the push button in order to cause outward unseating of the stem and actuator from the reset ring, and upon alignment of recess notches configured in the central inner annular surface of the ring with axial embossments configured on the exterior of the push button stem (and as previously described).

Figure 6:
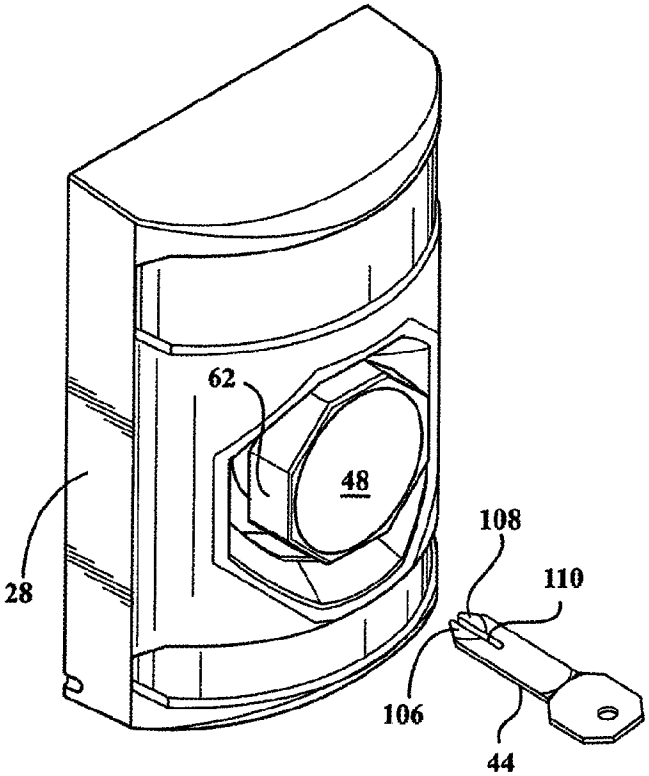
FIG. 6 is a front perspective of the variant of FIG. 5 and illustrating the configuration of the key to reset component with dovetail engaging surfaces which engages a slot located underneath the push button in order to outwardly reset the same.

Referring further to FIG. 6, a front perspective of the variant of FIG. 5 is shown again illustrates the configuration of the key to reset component 44, this including dovetail engaging inner surfaces 106 and 108 with corresponding angled edges 106' and 108' which are defined in upper receiving contoured and angled edge surfaces associated with elongated and inserting fork portions of the key, such further including an end communicating and inwardly extending slot 110 which separates the dovetail and edge contoured surfaces 106/108 (with further reference being made to FIGS. 12A-12B and 13A-13B). Referencing again the front face of the push button subassembly in FIG. 8, a seating aperture 112 is configured underneath the push button portion 62, this further exhibiting a receiving location 114 (hidden from view in the assembly body 70 of FIG. 14 but depicted in cutaway in each of FIGS. 9-11) which receives the dovetail surfaces 106/108 and central slot 110 of the flattened stem of the key 44.

Figure 12A:
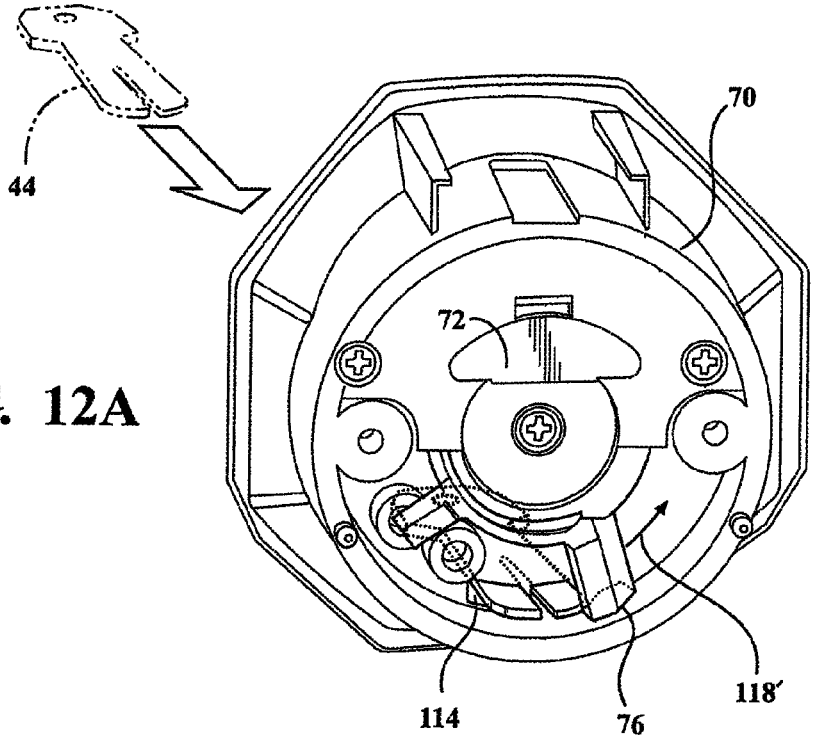
FIGS. 12A-12B are a first pair of perspective and partial cutaway illustrations of the key to reset configuration of the push button assembly and which illustrates an initial contact arrangement established between the ramped outer edge of the key shown in FIG. 6 and an opposing cam edge profile established in the radial projecting tab associated with the reset ring.
Figure 12B:
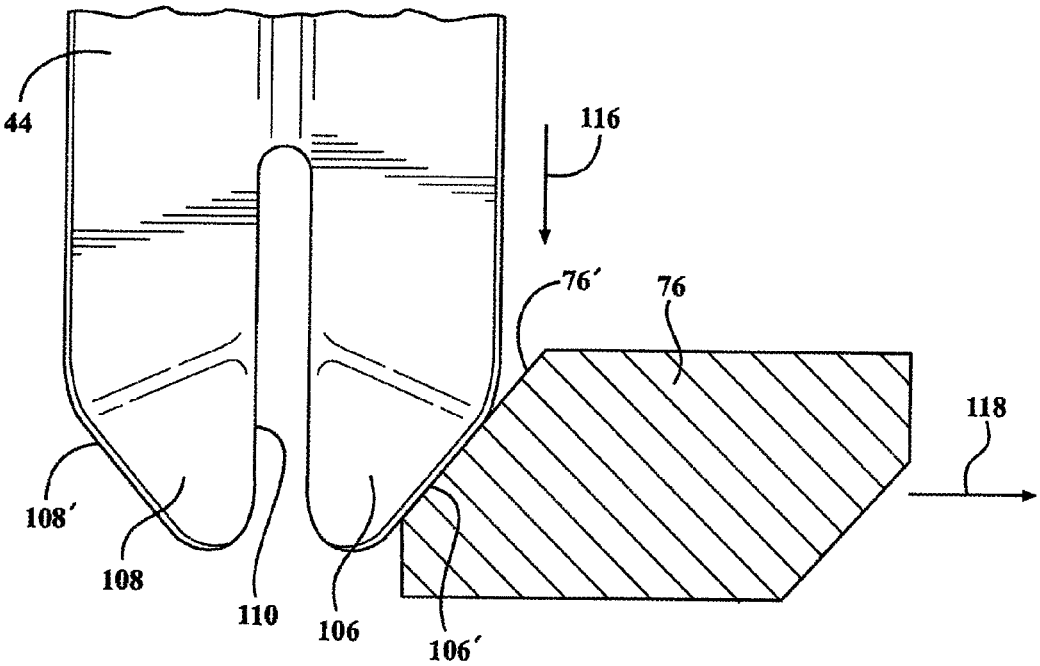
Figure 13A:
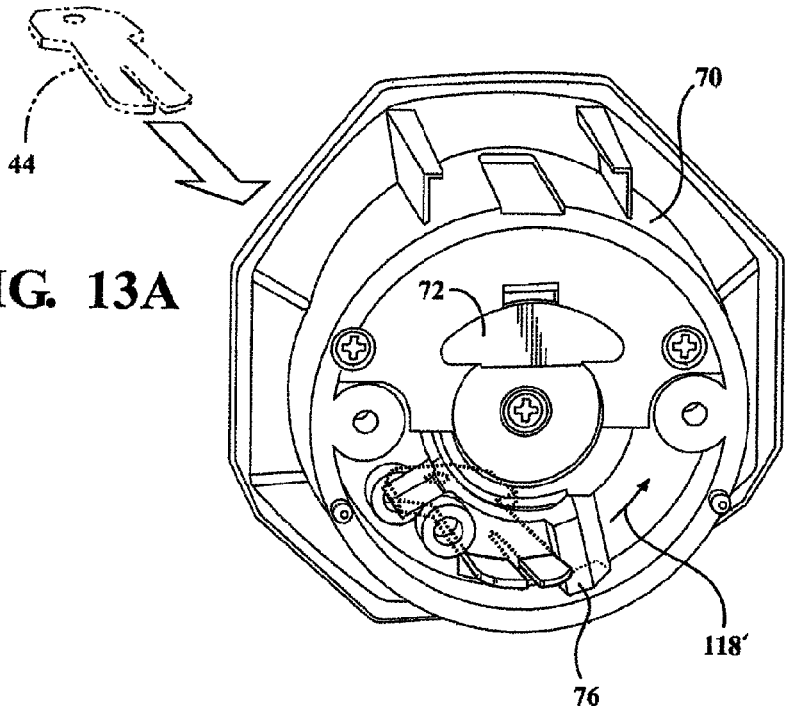
FIGS. 13A-13B mirror FIGS. 12A-12B and illustrate completion of the key insert motion and rotation of the reset ring, in a manner similar to as previously described in the rotate to reset configuration of FIG. 10B, and in which outward unseating of the stem and actuator from the reset ring occurs upon alignment of recess notches configured in the central inner annular surface of the ring with axial embossments configured on the exterior of the push button stem, thereby allowing the push button to reverse outwardly displace to its original/pre-depressed condition.
Figure 13B:
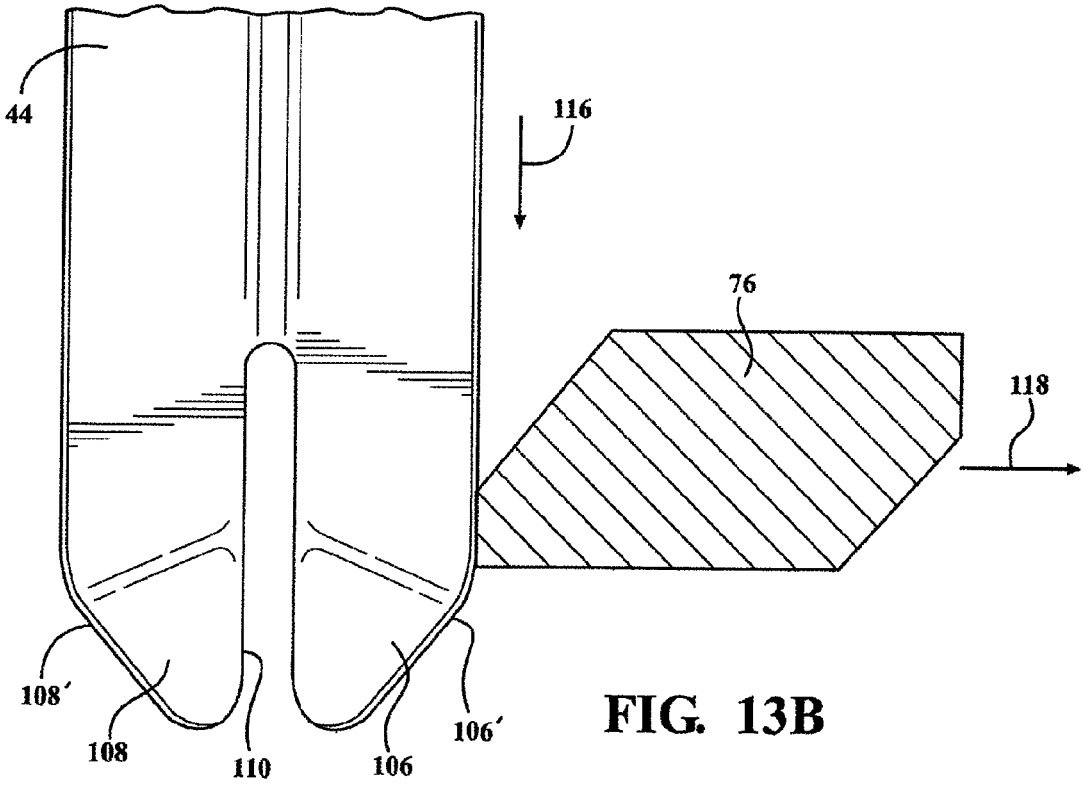

FIG. 12A-12B are a first pair of perspective and partial cutaway illustrations of the key to reset configuration of the push button assembly and which illustrates an initial contact arrangement established between the ramped outer edge 106' of the key 44 shown in FIG. 6 and an opposing cam edge profile 76' established in the radial projecting tab 76 associated with the reset ring 88. FIGS. 13A-13B mirror FIGS. 12A-12B and illustrate completion of the key insert motion and rotation of the reset ring, in a manner similar to as previously described in the rotate to reset configuration of FIG. 10B, and in which outward unseating of the stem 86 and actuator from the reset ring 77 occurs upon alignment of recess notches 85 configured in the central inner annular surface 100 of the ring with the axial embossments 87/89 configured on the exterior of the push button stem 86, thereby allowing the push button 62 to reverse outwardly displace to its original/pre-depressed condition.

As shown in succession in FIGS. 12-13, continued inward sliding of the key 44 (shown in intermediate contacting position with the tab 76 in FIGS. 12A-12B and in subsequent completed inserted to rotational displaced condition in FIGS. 13A-13B (see also directional arrows at 116 representing axial insertion of the key 44 and further at 118/118' representing rotation of the tab 76 and overall ring 77), creates an unseating event to allow return outward displacement of the push button 62. As best again shown in FIGS. 12-13, this can include rotation of the of the reset ring 77 upon contact of angled edge surface 108' of the key 44 against the cam edge profile 76' of the tab 76, such that the inner radial profile 100 (again shown in FIG. 14 as well as in cutaway in each of FIGS. 9A-11) otherwise blocking reverse actuation of the embossed axial portions 87/89 of actuator portion 88 is thereby unseated and the main spring 84 once again outwardly displaces ("pops-out") the mushroom push button 62 to the reset position.

It is further understood that the kit and assembly can be continually reconfigured in order to change the push button function between any of the momentary, turn-to-reset or key-to-reset variants. This can include detaching the push-button subassembly 16 and mounting back plate 26, from the gang box 24 (such as by removing the contact block screws from the mounting plate), detaching the switch contacts, reconfiguring the sub-assembly as described in the alternate variants of FIGS. 2-6, and reassembling.

Figure 7:
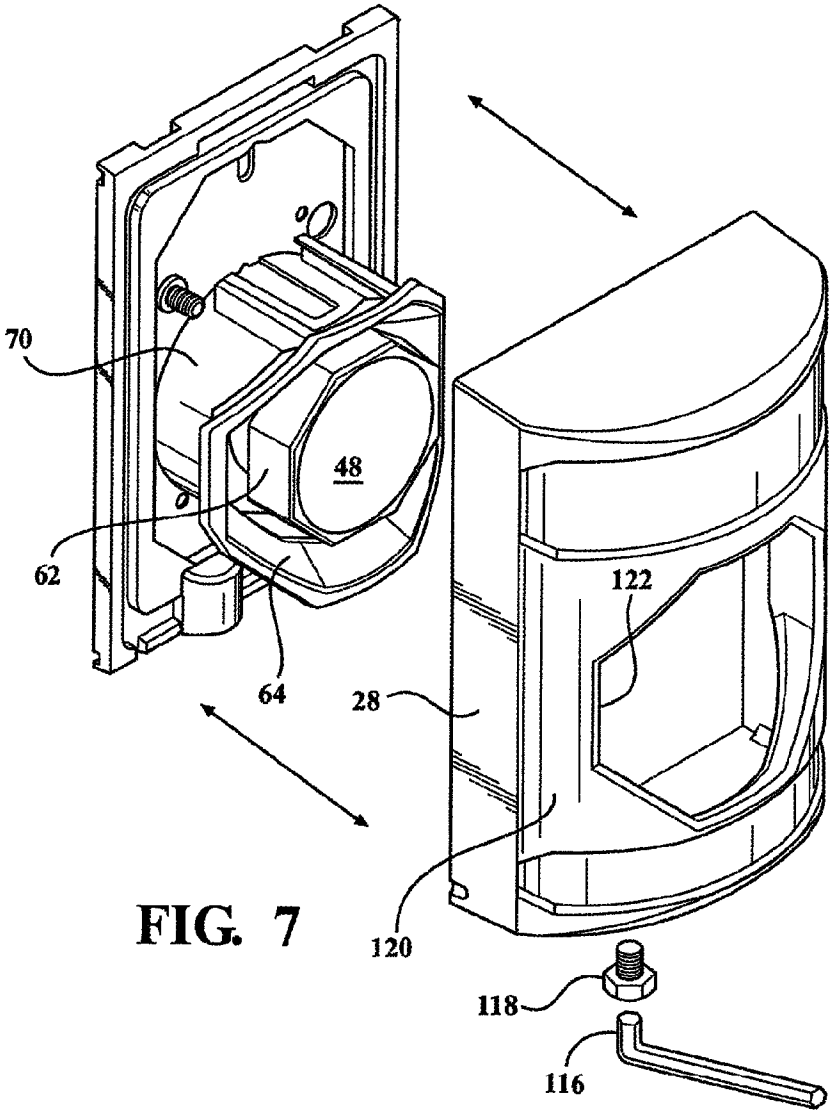
FIG. 7 is a partially exploded view of the pull station housing and manner of attaching to the push button and switch assembly.

FIG. 7 is a partially exploded view of the pull station housing and manner of attaching to the push button and switch assembly, and which can include a suitable hex head wrench 116 engaging such as an Allen head screw 118 seating through a bottom recess (not shown) in the three dimensional housing cover 28 for engaging a likewise hidden underside location of the indicated subassembly 16. The three dimensional cover 28 further exhibits a sloping front surface 120 with a perimeter defining recess (see at 122 which references an octagonal selected configuration) for receiving the particular configuration of the mushroom shaped push button 62.

As also previously described, the sloping sides of the cover serve to shield the mushroom button 62 in a generally seated/recessed manner to prevent inadvertent depressed triggering from a side location (and as opposed to intentional depressed triggering from the front of the assembly). Without limitation, it is further understood that the cover 28 can be reconfigured with a transparent or substantially translucent non-apertured display surface and can be pivotally mounted to the front face of the alarm station 10, such further required to be rotated upwardly in order to expose the push button for actuation. Additional variants of the invention can contemplate a warning alarm being wired into upward rotation of the cover, such as in order to deter against frivolous actuation thereof.

Having described our invention, other and additional preferred embodiments will become apparent to those skilled in the art to which it pertains, and without deviating from the scope of the appended claims.

We claim:

1. A push-button assembly incorporated into an alarm station, the station including a supporting gang box and back plate containing a switch box and switches, said assembly comprising:

a body adapted to being mounted to the back plate, said body incorporating an axially displaceable push button with an inwardly displaceable stem terminating in an actuator base, said actuator base adapted to being engaged through an aperture in said back plate and into contact with the switch box; and a reset ring rotatably supported within said body, said ring being repositionable in order to accommodate multi-variant reconfiguration of said body to vary a resetting operation of said push button following initial depressing of the same and in which a coil spring secured to an underside of said push button outwardly biases said push button, said resetting operations including at least one of a momentary push to reset and a delayed resetting of said push button.

2. The assembly as described in claim 1, further comprising a wedge block attachable to a rear surface of said body, a stop pin further engageable with a first receiving location also on said rear surface of said body to define an impeding contact point with said ring and, upon a counter-clockwise rotation of said ring away from said stop pin, establishing said momentary push to reset.

3. The assembly as described in claim 2, further comprising said stop pin being removed from said first receiving location and, in combination with said reset ring being rotated in a clockwise direction, converting said push button to a delayed key to reset.

4. The assembly as described in claim 2, further comprising a delayed turn to reset accomplished by removal of said wedge block from said body in combination with repositioning of said stop pin from said first receiving location to a second receiving location upon said rear surface of said body and such that rotation of said inwardly actuated push button provides for resetting thereof.

5. The assembly as described in claim 1, further comprising a reset return spring biasing said return ring in a selected rotational direction.

6. The assembly as described in claim 3, further comprising a key having at least one of a contoured side or edge engagement surface which is inserted through an aperture in a front face of said body below said axially displaceable push button, said engagement surface engaging a projecting tab of said reset ring in order to displace the same out of contact with said actuator base.

7. The assembly as described in claim 1, further comprising an LED element mounted to an exteriorly facing shroud associated with said body and within which said push button is located and for illuminating at least a perimeter of said push button.

8. A push-button assembly incorporated into an alarm station, the station including a supporting gang box and back plate containing a switch box and switches, said assembly comprising:

a body adapted to being mounted to the back plate, said body incorporating an axially displaceable push button with an inwardly displaceable stem terminating in an actuator base, said actuator base adapted to being engaged through an aperture in said back plate and into contact with the switch box; and a reset ring rotatably supported within said body, said ring including an annular shape with an inner perimeter rim through which said stem extends, at least one axial embossment on said stem engaging said inner rim of said ring following initial depressing of said push button;

said reset ring further comprising recesses configured within said inner perimeter rim and which, upon inter-rotational motion relative to said stem, said recesses aligning with said axial embossments such that a coil spring secured to an underside of said push button outwardly biases said push button in a delayed resetting of said push button.

9. The assembly as described in claim 8, further comprising a wedge block attachable to a rear surface of said body, a stop pin further engageable with a first receiving location also on said rear surface of said body to define an impeding contact point with said ring and, upon a counter-clockwise rotation of said ring away from said stop pin, establishing a further momentary push to reset reconfiguration of said assembly.

10. The assembly as described in claim 9, further comprising said stop pin being removed from said first receiving location and, in combination with said reset ring being rotated in a clockwise direction, the delayed resetting of said push button further including converting said push button to a delayed key to reset configuration.

11. The assembly as described in claim 9, said delayed resetting of said push button further comprising a delayed turn to reset accomplished by removal of said wedge block from said body in combination with repositioning of said stop pin from said first receiving location to a second receiving location upon said rear surface of said body and such that rotation of said inwardly actuated push button provides for resetting thereof.

12. The assembly as described in claim 8, further comprising a reset return spring biasing said return ring in a selected rotational direction.

13. The assembly as described in claim 10, further comprising a key having at least one of a contoured side or edge engagement surface which is inserted through an aperture in a front face of said body below said axially displaceable push button, said engagement surface engaging a projecting tab of said reset ring in order to displace the same out of contact with said actuator base.

14. The assembly as described in claim 8, further comprising an LED element mounted to an exteriorly facing shroud associated with said body and within which said push button is located and for illuminating at least a perimeter of said push button.

15. A kit assembly for constructing an alarm station, comprising:

a supporting gang box and back plate containing a switch box and switches;

a push button assembly including a body adapted to being mounted to the back plate, said body incorporating an axially displaceable push button with an inwardly displaceable stem terminating in an actuator base, said actuator base adapted to being engaged through an aperture in said back plate and into contact with the switch box; and a reset ring rotatably supported within said body, said ring including an annular shape with an inner perimeter rim through which said stem extends, at least one axial embossment on said stem engaging said inner rim of said ring following initial depressing of said push button;

said reset ring further comprising recesses configured within said inner perimeter rim and which, upon inter-rotational motion relative to said stem, said recesses aligning with said axial embossments such that a coil spring secured to an underside of said push button outwardly biases said push button in a delayed resetting of said push button.

16. The kit as described in claim 15, further comprising a wedge block attachable to a rear surface of said body, a stop pin further engageable with a first receiving location also on said rear surface of said body to define an impeding contact point with said ring and, upon a counter-clockwise rotation of said ring away from said stop pin, establishing a further momentary push to reset reconfiguration of said assembly.

17. The kit as described in claim 16, further comprising said stop pin being removed from said first receiving location and, in combination with said reset ring being rotated in a clockwise direction, the delayed resetting of said push button further including converting said push button to a delayed key to reset configuration.

18. The kit as described in claim 16, said delayed resetting of said push button further comprising a delayed turn to reset accomplished by removal of said wedge block from said body in combination with repositioning of said stop pin from said first receiving location to a second receiving location upon said rear surface of said body and such that rotation of said inwardly actuated push button provides for resetting thereof.

19. The kit as described in claim 15, further comprising a reset return spring biasing said return ring in a selected rotational direction.

20. The kit as described in claim 17, further comprising a key having at least one of a contoured side or edge engagement surface which is inserted through an aperture in a front face of said body below said axially displaceable push button, said engagement surface engaging a projecting tab of said reset ring in order to displace the same out of contact with said actuator base.

* * * * *